US009966716B2

(12) United States Patent
Soohoo et al.

(10) Patent No.: US 9,966,716 B2
(45) Date of Patent: May 8, 2018

(54) ADAPTER

(71) Applicant: Apple Inc., Cupertino, CA (US)

(72) Inventors: Eric T. Soohoo, Sunnyvale, CA (US); Eric S. Jol, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days. days.

(21) Appl. No.: 15/062,221

(22) Filed: Mar. 7, 2016

(65) Prior Publication Data

US 2017/0070019 A1 Mar. 9, 2017

Related U.S. Application Data

(60) Provisional application No. 62/215,721, filed on Sep. 8, 2015, provisional application No. 62/254,074, filed on Nov. 11, 2015.

(51) Int. Cl.

| | |
|---|---|
| ***H01R 31/06*** | (2006.01) |
| ***H01R 13/652*** | (2006.01) |
| ***H01R 13/506*** | (2006.01) |
| *H01R 24/60* | (2011.01) |

(52) U.S. Cl.

CPC ..... *H01R 31/06* (2013.01); *H01R 13/506* (2013.01); *H01R 13/652* (2013.01); *H01R 24/60* (2013.01)

(58) Field of Classification Search

CPC ..... H01R 24/54; H01R 25/00; H01R 31/06; H01R 33/88; H01R 33/94; H01R 24/58; H01R 24/60; H01R 24/38; H01R 24/62; H01R 13/652; H01R 13/506

USPC ..... 439/638, 668, 675, 676, 108

See application file for complete search history.

(56) References Cited

U.S. PATENT DOCUMENTS

| | | | | |
|---|---|---|---|---|
| 4,379,609 | A * | 4/1983 | Hardesty | H01R 24/62 439/344 |
| 4,707,044 | A | 11/1987 | Burns | |
| 4,799,901 | A | 1/1989 | Pirc | |
| 4,904,209 | A | 2/1990 | Nelson | |
| 5,041,024 | A * | 8/1991 | Liu | H01R 31/06 439/654 |
| 5,352,133 | A * | 10/1994 | Sampson | H01R 13/6271 439/357 |
| 5,766,020 | A * | 6/1998 | Hughes | B60D 1/64 439/35 |
| 6,383,028 | B1 * | 5/2002 | Chang | H01R 31/06 439/638 |
| 6,494,747 | B1 * | 12/2002 | Hwang | H01R 31/06 439/638 |

(Continued)

FOREIGN PATENT DOCUMENTS

| | | |
|---|---|---|
| CN | 2772073 | 4/2006 |
| CN | 200997477 | 12/2007 |

(Continued)

OTHER PUBLICATIONS

U.S. Appl. No. 13/492,608 , "Non-Final Office Action", dated Apr. 9, 2015, 10 pages.

(Continued)

*Primary Examiner* — Tulsidas C Patel
*Assistant Examiner* — Travis Chambers
(74) *Attorney, Agent, or Firm* — Kilpatrick Townsend & Stockton, LLP

(57) ABSTRACT

Adapters that are small in size and may be readily assembled.

24 Claims, 10 Drawing Sheets

(56) References Cited

U.S. PATENT DOCUMENTS

| | | | | |
|---|---|---|---|---|
| 6,554,650 | B2 * | 4/2003 | Kayworth | H01R 31/06 439/323 |
| 6,648,695 | B1 * | 11/2003 | Wu | H01R 31/06 439/638 |
| 6,908,324 | B1 * | 6/2005 | Morley | H01R 31/06 439/11 |
| 6,945,821 | B2 * | 9/2005 | Stoner | H01R 31/06 439/638 |
| 7,029,322 | B2 * | 4/2006 | Ernst | G02B 6/4277 385/56 |
| 7,264,479 | B1 | 9/2007 | Lee | |
| 7,794,274 | B2 * | 9/2010 | Phillips, Jr. | H01R 13/187 439/578 |
| 8,172,580 | B1 | 5/2012 | Chen et al. | |
| 8,241,043 | B1 | 8/2012 | Lin | |
| 8,387,466 | B2 | 3/2013 | Nishigaki et al. | |
| 8,517,772 | B2 * | 8/2013 | Wu | H01R 24/62 439/501 |
| 8,727,326 | B2 | 5/2014 | Lin et al. | |
| 9,209,547 | B2 | 12/2015 | Lozano et al. | |
| 2005/0009404 | A1 * | 1/2005 | Lee | H01R 31/06 439/638 |
| 2005/0282442 | A1 * | 12/2005 | Hyland | H01R 31/005 439/676 |
| 2007/0197057 | A1 | 8/2007 | Wu | |
| 2008/0096435 | A1 * | 4/2008 | Mills | H01R 25/00 439/668 |
| 2010/0240229 | A1 | 9/2010 | Firman, II et al. | |
| 2012/0156909 | A1 | 6/2012 | Price | |
| 2013/0040470 | A1 | 2/2013 | Gao et al. | |
| 2013/0328484 | A1 | 12/2013 | Villarreal et al. | |
| 2014/0220793 | A1 | 8/2014 | Yen et al. | |
| 2015/0056859 | A1 * | 2/2015 | Higuchi | H01R 13/6473 439/607.41 |
| 2015/0140868 | A1 | 5/2015 | Do et al. | |
| 2016/0056583 | A1 * | 2/2016 | Chuang | H01R 13/6581 439/607.01 |

FOREIGN PATENT DOCUMENTS

| | | | |
|---|---|---|---|
| CN | 103490252 | | 1/2014 |
| CN | 203589409 | | 5/2014 |
| DE | 202008014989 | | 2/2009 |
| DE | 102008038641 | | 3/2009 |
| DE | 102013222942 | A1 | 5/2015 |
| EP | 2760085 | A1 | 7/2014 |
| JP | H01-186772 | A | 7/1989 |
| JP | 2011-243304 | A | 12/2011 |
| JP | 2015-065167 | A | 4/2015 |
| JP | 2015-511380 | A | 4/2015 |
| KR | 10-2013-0094837 | A | 8/2013 |
| TW | 201405983 | | 2/2014 |
| WO | 2011136498 | | 11/2011 |
| WO | 2013184906 | | 12/2013 |
| WO | 2013184906 | | 2/2014 |

OTHER PUBLICATIONS

U.S. Appl. No. 13/492,608 , "Notice of Allowance", dated Jul. 28, 2015, 7 pages.

U.S. Appl. No. 13/492,608 , "Restriction Requirement", dated Jan. 30, 2015, 5 pages.

CN201310374122.2 , "Office Action", dated Mar. 25, 2015, 10 pages.

CN201310374122.2 , "Office Action", dated Sep. 29, 2015, 6 pages.

CN201320521108.6 , "Office Action", dated Oct. 29, 2013, 1 page.

PCT/US2013/044495 , "International Preliminary Report on patentability", dated Dec. 18, 2014, 13 pages.

PCT/US2013/044495 , "International Search Report and Written Opinion", dated Nov. 11, 2013, 19 pages.

PCT/US2013/044495 , "Invitation to Pay Additional Fees and Partial Search Report", dated Aug. 26, 2013, 6 pages.

TW102120400 , "Office Action", dated Apr. 18, 2016, 4 pages.

TW102120400 , "Office Action", dated Sep. 21, 2015, 4 pages.

Office Action (English Translation) dated Jul. 18, 2017 in Korean Patent Application No. 10-2016-0111875, 7 pages.

Examination Report dated Jul. 27, 2017 in Australian Patent Application No. 2016225815, 4 pages.

European Search Report dated Dec. 16, 2016 in European Patent Application No. 16186529.0, 9 pages.

Office Action (English Translation) dated Sep. 29, 2017 in Japanese Patent Application No. 2016-169763, 6 pages.

* cited by examiner

ADAPTER

CROSS REFERENCE TO RELATED APPLICATIONS

This application is a nonprovisional of U.S. provisional application Nos. 62/215,721, filed Sep. 8, 2015, and 62/254,074, filed Nov. 11, 2015, which are incorporated by reference.

BACKGROUND

The number of types of electronic devices that are commercially available has increased tremendously the past few years and the rate of introduction of new devices shows no signs of abating. Devices, such as tablet, laptop, netbook, desktop, and all-in-one computers, cell, smart, and media phones, storage devices, portable media players, wearable computing devices, navigation systems, monitors, and others, have become ubiquitous.

Power and data may be provided from one device to another over cables that may include one or more wire conductors, fiber optic cables, or other conductors. Connector inserts may be located at each end of these cables and may be inserted into connector receptacles in the communicating or power transferring devices.

Some devices may include a connector insert on the device itself, in place of a connector receptacle. The motivation for including a connector insert may be size or other reasons. That is, a connector insert may be smaller than a connector receptacle and may be included on a device in place of a connector receptacle for this reason. In such a situation, it may not be possible to connect a connector insert on a cable directly to a connector insert on a device.

In such cases an adapter may be of use. For example, a "female-to-female" adapter may be used. Such an adapter may have a connector receptacle on each end of a housing. A first connector receptacle at a first end of the adapter may accept a connector insert at an end of a cable and a second connector receptacle at a second end of the adapter may accept a connector insert on the device. In this way, the device may be able to communicate and share power with a second device at the far end of the cable.

Unfortunately, these adapters may be large and bulky. Also, they may be complicated and made of many individual parts. This complexity may make the adapters expensive to manufacture and difficult to assemble.

Thus, what is needed are adapters that may be small in size and may be readily assembled.

SUMMARY

Accordingly, embodiments of the present invention may provide adapters that are small in size and may be readily assembled.

An illustrated embodiment of the present invention may provide an adapter having a first receptacle connected to a second receptacle. The second receptacle may be configured to interoperate with a device having a connector insert or plug emerging from it. This connector insert may be longer than a conventional connector insert of the same type and the second receptacle may be longer or deeper to accept the longer connector insert. This may prevent conventional connector inserts from being inserted into the second receptacle. A conventional connector insert, for example on a cable, may be inserted into the first receptacle.

An illustrated embodiment of the present invention may provide an adapter having smaller size by providing contacts that have first contacting portions in the first receptacle and second contacting portions in the second receptacle. That is, contacts extending into each receptacle may be stamped or otherwise formed as a single piece. This eliminates the need to join separate contacts in each connector receptacle to each other, a simplification which may allow the adapter to have a short length. Similarly, shared side ground contacts may be used where each side ground contact has a first contacting portion in the first receptacle and a second contacting portion in the second receptacle. A first retention force provided by the first contacting portion may be greater than a second retention force provided by the second contacting portion. For example, the side ground contact may not extend as far into the second receptacle as it does in the first receptacle. In these and other embodiments, the shape of the side ground contacts may be different in the second receptacle, for example it may have less curvature. This may prevent the adapter from remaining attached to the device when the cable is disconnected from the device. That is, the adapter may tend to remain fixed to the cable connector insert when the cable is pulled away from the device.

The adapter may include a first housing for the first receptacle and a second housing for the second receptacle. These housings may mechanically lock or snap together. A compressible or otherwise adjustable region may exist between them. This may help in positioning edges of the first housing and the second housing with edges of an outer housing that may surround the first and second housing. The side ground contacts may be attached to a boss on one of the first or second housings using heat staking. The contacts may include features such as crush ribs to mechanically lock the contacts to the housings.

In various embodiments of the present invention, components of the adapters may be formed in various ways of various materials. For example, conductive portions may be formed by stamping, metal-injection molding, machining, micro-machining, 3-D printing, or other manufacturing process. The conductive portions may be formed of stainless steel, steel, copper, copper titanium, phosphor bronze, palladium, palladium silver, or other material or combination of materials. They may be plated or coated with nickel, gold, or other material. The nonconductive portions, such as the housings and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide adapters that may be connected to various types of devices, such as portable computing devices, tablet computers, desktop computers, laptops, all-in-one computers, wearable computing devices, cell phones, smart phones, media phones, storage devices, cases, covers, keyboards, pens, styluses, portable media players, navigation systems, monitors, power supplies, adapters, remote control devices, chargers, and other devices. These adapters may include connector receptacles or connector inserts that may provide pathways for signals and power compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
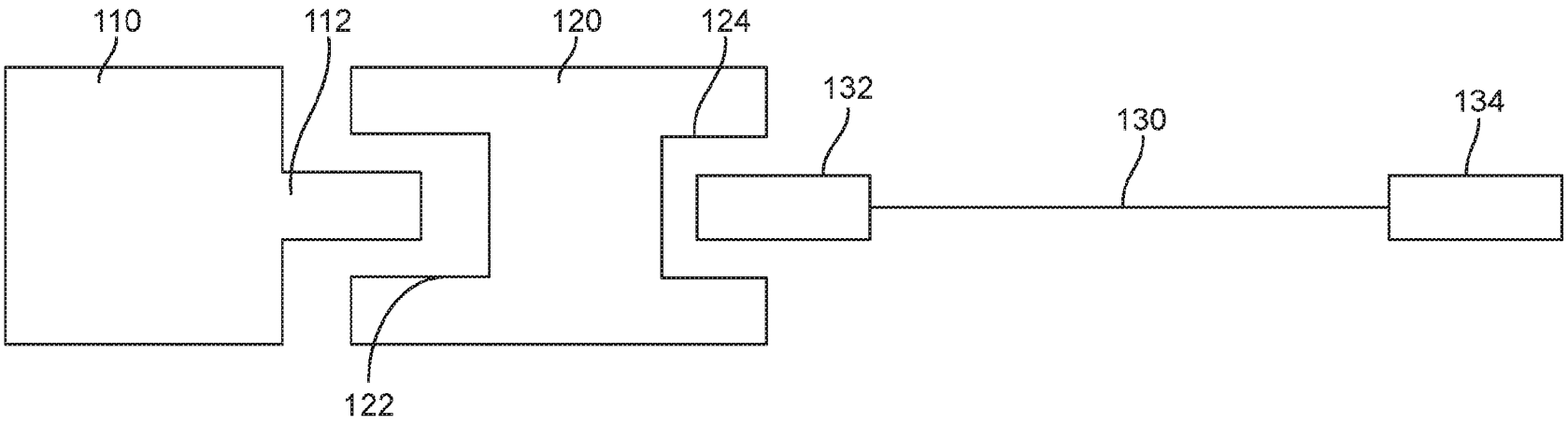
FIG. 1 illustrates an electronic system including an adapter according to an embodiment of the present invention.

FIG. 1 illustrates an electronic system including an adapter according to an embodiment of the present invention. This figure, as with the other included figures, is shown for illustrative purposes and does not limit either the possible embodiments of the present invention or the claims.

In this electronic system, electronic device 110 may include connector insert 112. Connector insert 112 may emerge from a surface of device 110, or connector insert 112 may be connected to electronic device 110 through a cable or other conductor. Adapter 120 may include a first receptacle 122 to accept connector insert 112. In various embodiments of the present invention, connector insert 112 may be longer than a conventional connector insert of its type. Accordingly, connector receptacle 122 may be correspondingly longer as well. This may prevent conventional connector inserts of the same type from being inserted into connector receptacle 122. Instead, by providing connector receptacle 122 with a greater depth, connector receptacle 122 may be reserved for use with devices 110 and their connector inserts 112.

Adapter 120 may include a second connector receptacle 124. Connector receptacle 124 may accept a connector insert or plug 132 on cable 130. Cable 130 may terminate in connector insert 134. In various embodiments the present invention, connector insert 132 and connector insert 134 may be the same different types of connector inserts.

In a specific embodiment of the present invention, connector inserts 112 and 132 may be Lightning connector inserts, or they may have form factors that are compatible with Lightning connector receptacles. Connector receptacles 122 124 may also be Lightning connector receptacles, or they may have form factors that are compatible with Lightning connector inserts. Connector insert 134 may be a different type of connector insert, such as a USB Type-C connector.

Figure 2:
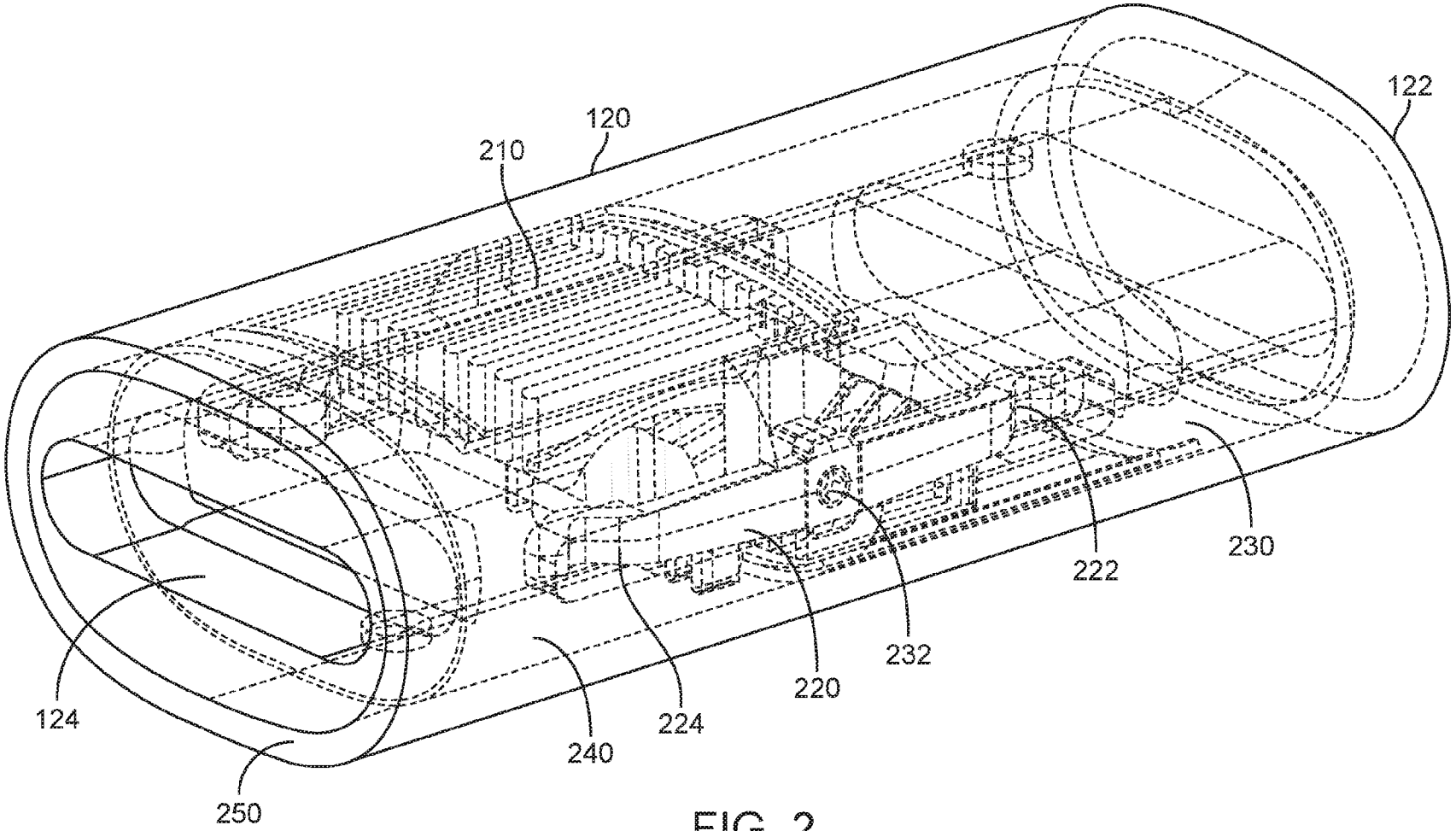
FIG. 2 illustrates a transparent view of an adapter according to an embodiment of the present invention.

FIG. 2 illustrates a transparent view of an adapter according to an embodiment of the present invention. Adapter 120 may include openings for receptacles 122 and 124. Contacts 210 may have contacting portions in each of the connector receptacles 122 and 124. A first housing 230 may be included for receptacle 122 and a second housing 240 may be included for receptacle 124. The first and second housings 230 and 240 may snap or otherwise be mechanically connected together. Outer housing 250 may surround first housing 230 and second housing 240. Side ground contacts 220 may be shared between the first connector receptacle 122 and second connector receptacle 124. Side ground contacts 220 may include a first contacting portion 222 in a first receptacle 122 and a second contacting portion 224 in the second connector receptacle 124. In various embodiments of the present invention, the retention force provided by the first contacting portion 222 may be less than the retention force provided by the second contacting portion 224, though in other embodiments of the present invention, the retention forces may be equal or the retention force provided by the first contacting portion 222 may be more than the retention force provided by the second contacting portion 224. Having the retention force provided by the first contacting portion 222 be less than the retention force provided by the second contacting portion 224 may ensure that when cable 130 is pulled away from device 110, adapter 120 may stay connected to cable 130 and may detach from device 110 (as shown in FIG. 1). That is, the retention force in receptacle 124 may be higher such that connector insert 132 remains in place in connector receptacle 124, and the retention force in receptacle 122 may be lower, such that connector insert 112 detaches from connector receptacle 122 when cable 130 is pulled away from device 110 (as shown in FIG. 1).

In various embodiments of the present invention, it may be desirable to align an outside of second housing 240 to an outside edge of housing 250. A may also be desirable to align an outside edge of first housing 230 with an outside edge of outer housing 250. Accordingly, a compressible or otherwise adjustable or compliant region may be placed or located between first housing 230 and second housing 240. In this way, the spacing between first housing 230 and second housing 240 may be adjusted thereby allowing the outside edges of housings 230 and 240 to be aligned to the outside edges of outer housing 250.

In various embodiments of the present invention, side ground contacts 220 may be fastened to one of the first or second housings 230 and 240. In this example, a central opening in side ground contact 30 may be aligned with post 232 on first housing 230. Heat staking may be used to melt posts or boss 232 such that it becomes attached to side ground contacts 220.

Figure 3:
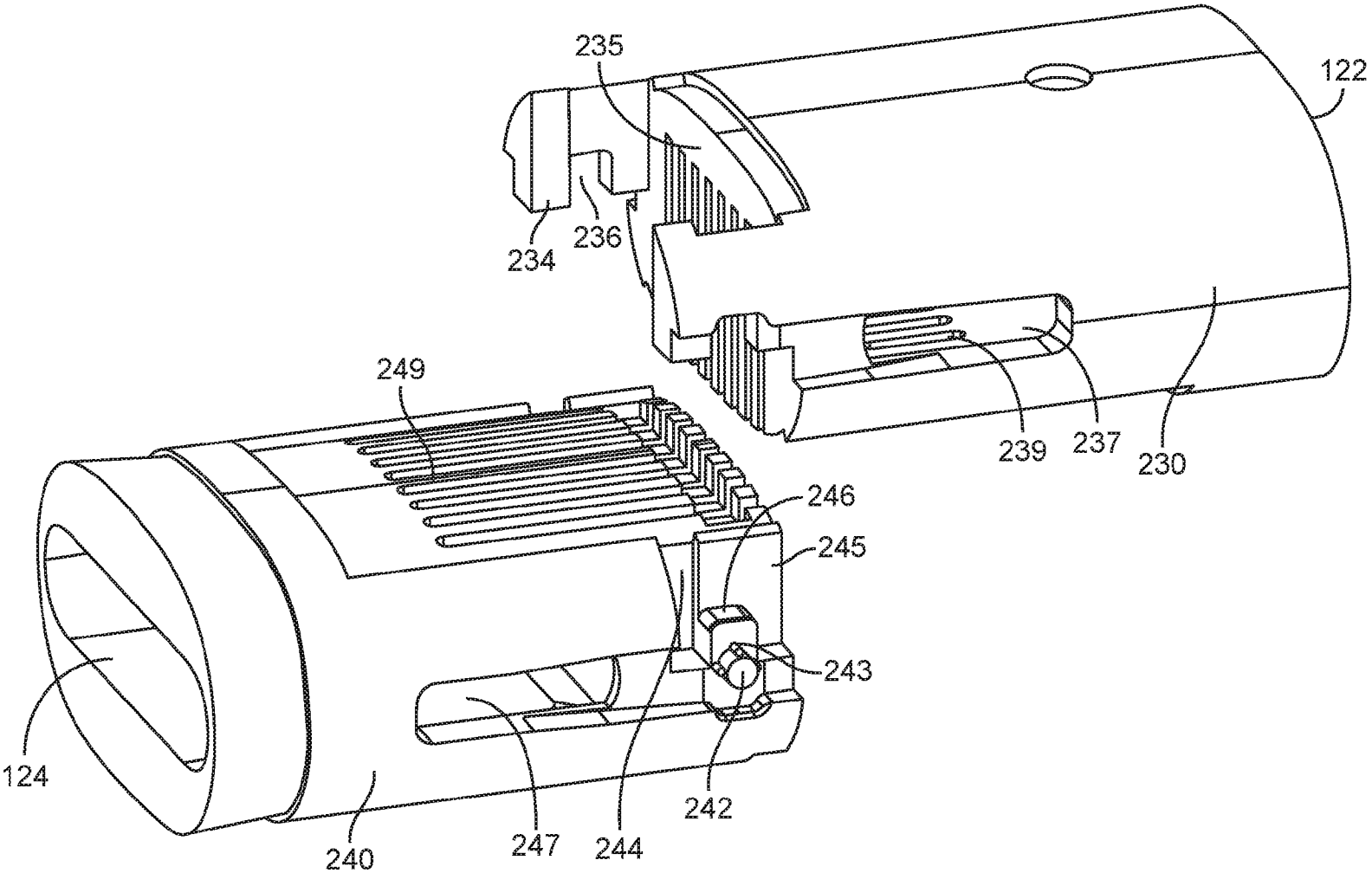
FIG. 3 illustrates housings that may be used in an adapter according to an embodiment of the present invention.

FIG. 3 illustrates housings that may be used in an adapter according to an embodiment of the present invention. A first housing 230 may be included for receptacle 122 and a second housing 240 may be included for receptacle 124. Housing 240 may include post 242 having crush ribs 243, over which an opening in side ground contact 220 (as shown in FIG. 2) may be fit, as well as side openings 247 for side ground contacts 220. Housing 240 may also include slots 249 for contacts 210 (as shown in FIG. 2.) Housing 230 may include side openings 237 for side ground contacts 220 and slots 249 for contacts 210 (as shown in FIG. 2.)

The first and second housings 230 and 240 may snap or otherwise be mechanically connected together during assembly. For example, tabs 234 on housing 230 may fit in slots 244 in housing 240. Notch 236 in housing 230 may fit over raised portion 246 on housing 240. Housing 230 may be lowered to snap together with housing 240 such that a rear 235 of housing 230 is adjacent to rear 245 of housing 240.

Figure 4:
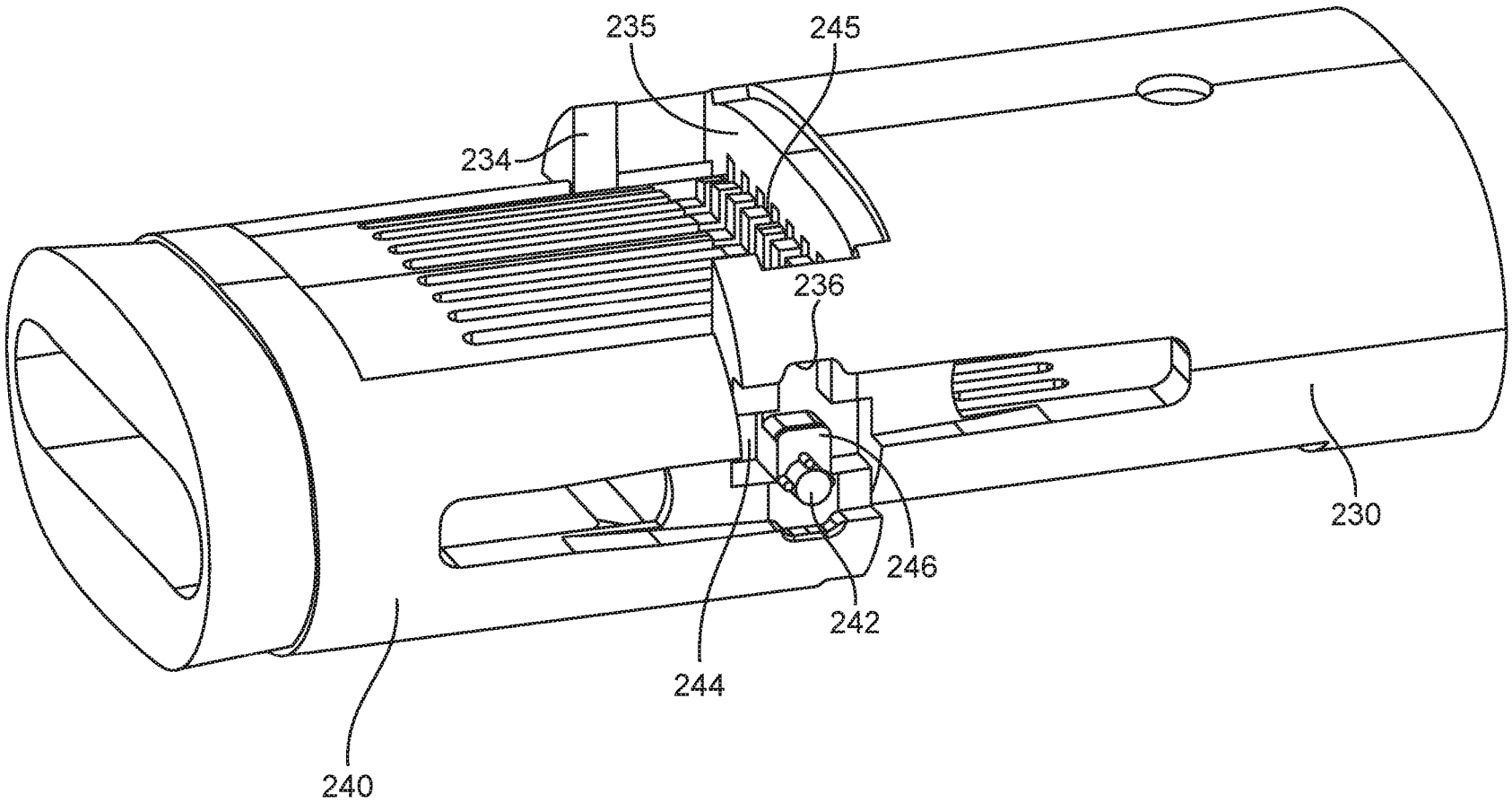
FIG. 4 illustrates housings being snapped together during the assembly of an adapter according to an embodiment of the present invention.

FIG. 4 illustrates housings being snapped together during the assembly of an adapter according to an embodiment of the present invention. Tabs 234 on housing 230 may fit in slots 244 in housing 240. Notch 236 in housing 230 may fit over raised portion 246 on housing 240. Housing 230 may be lowered to snap together with housing 240 such that a rear 235 of housing 230 is adjacent to rear 245 of housing 240. In this way, housings 230 and 240 may be fixed to each other. Outer housing 250 may be placed over housings 230 and 240.

Figure 5:
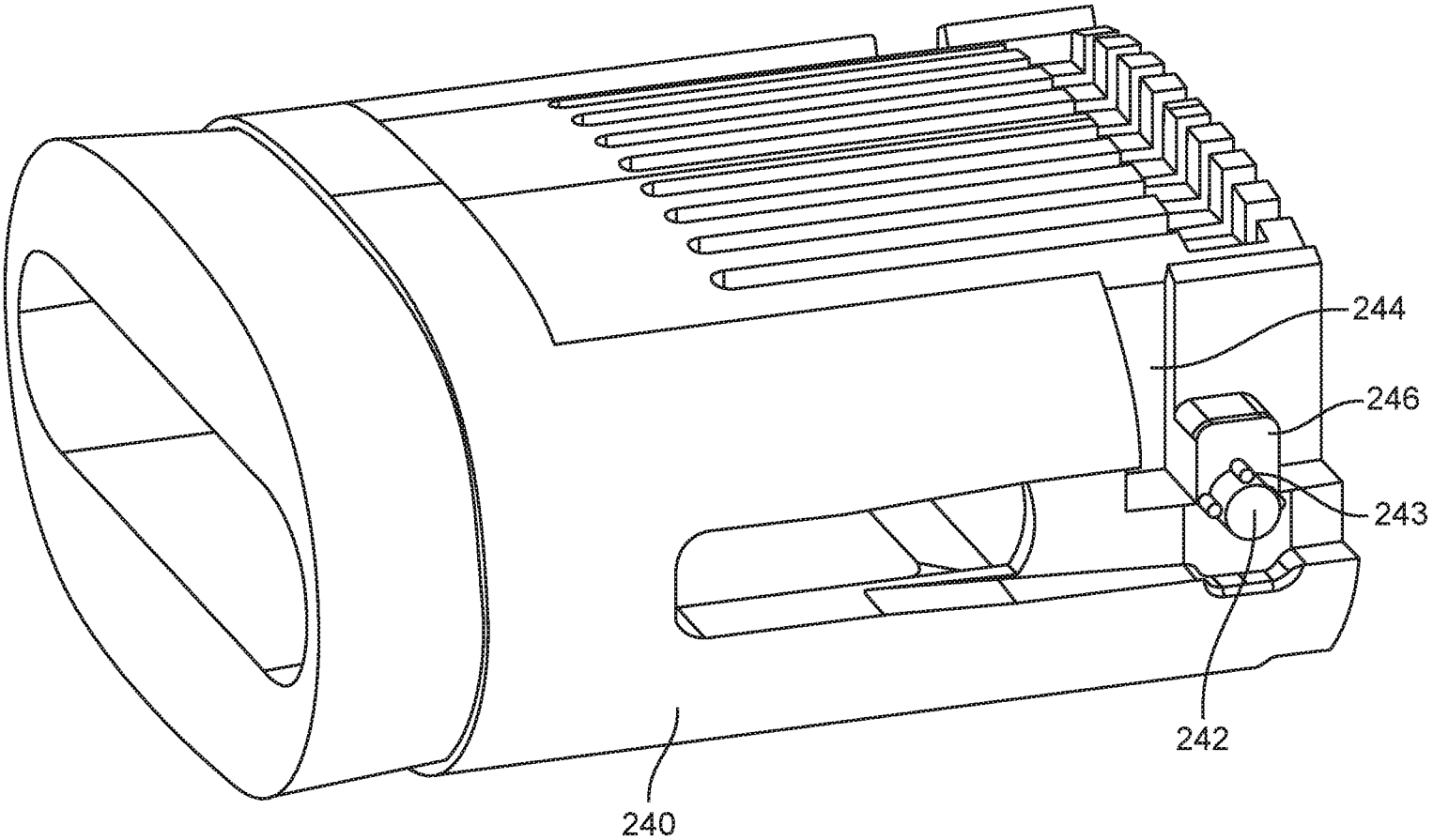
FIG. 5 is a close-up view of a housing that may be used in an adapter according to an embodiment of the present invention.

FIG. 5 is a close-up view of a housing that may be used in an adapter according to an embodiment of the present invention. Housing 240 may include slots 244 for accepting tabs on a second housing. Housing 240 may include post 242 having crush ribs 243. An opening of a side ground contact may be fit over post 242. Post 242 may be heat staked to fix the side ground contact in place. A notch on a second housing may fit over raised portion 146.

Figure 6:
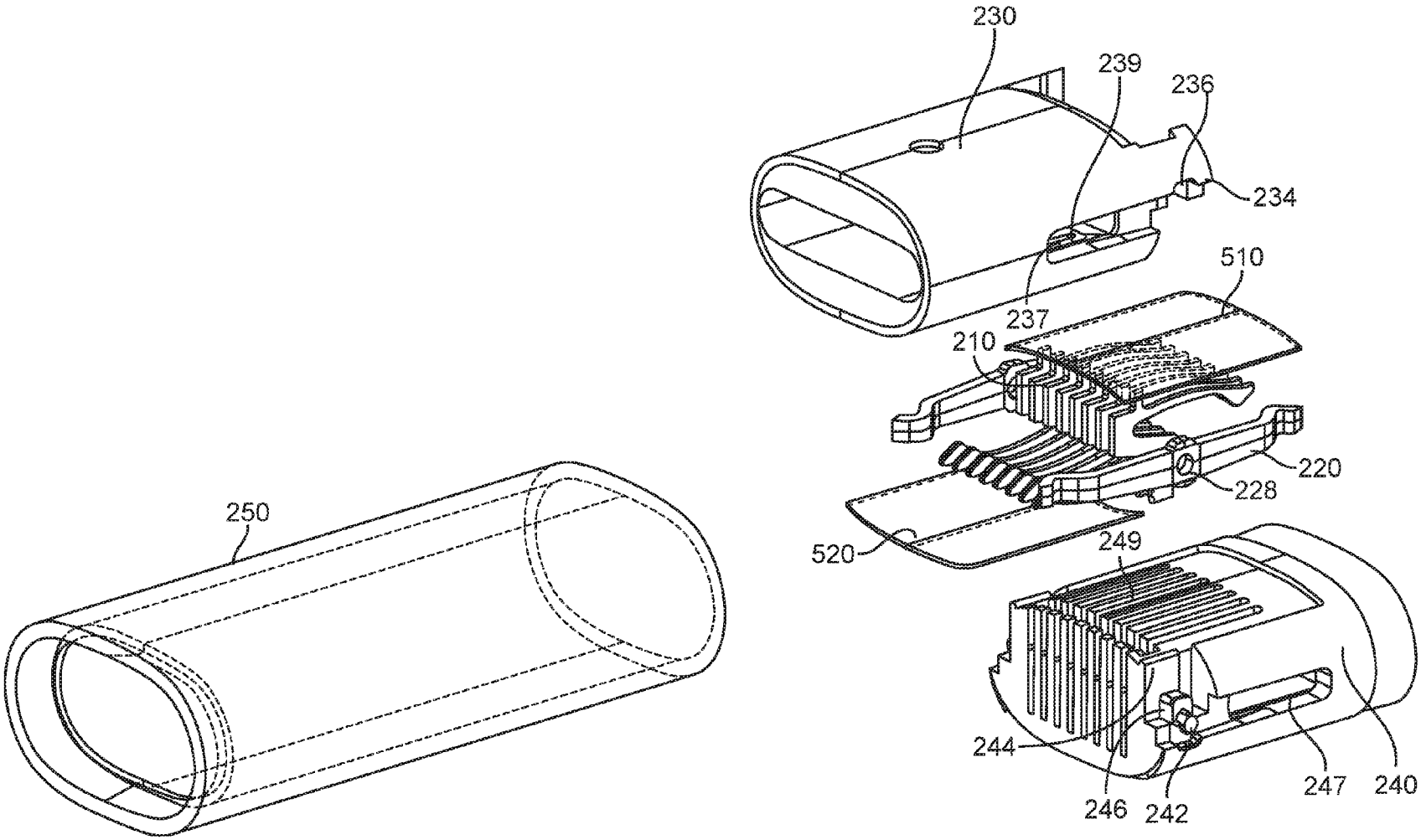
FIG. 6 illustrates an exploded view of an adapter according to an embodiment of the present invention.

FIG. 6 illustrates an exploded view of an adapter according to an embodiment of the present invention. Contacting portions of contacts 210 may be fit into slots 249 and barbed into housing 240 for mechanical stability. Housing 230 may be lowered relative to housing 240 such that tabs 234 on housing 230 may fit in slots 244 in housing 240, notch 236 in housing 230 may fit over raised portion 246 on housing 240, and contacts 210 may fit in slots 239 in housing 230. (Contacting portions of contacts 210 may instead be fit in slots 239 in housing 230 and then in slots 249 in housing 240 when housings 230 and 240 are snapped together.) Side ground contacts 220 may have openings 228 to fit over posts 242 on housing 240. That is, side ground contacts 220 may be attached at openings 228 to posts 232, again using heat staking or other techniques. Side ground contacts 220 may fit in openings 234 and 242 on the first and second housing 230 and 240 respectively. Insulating layers 510 and 520 may be placed over a top of housing 240 and a bottom of housing 230 to prevent contacts 210 from contacting outer housing 250. Outer housing 250 may surround first and second housings 230 and 240.

Figure 7:
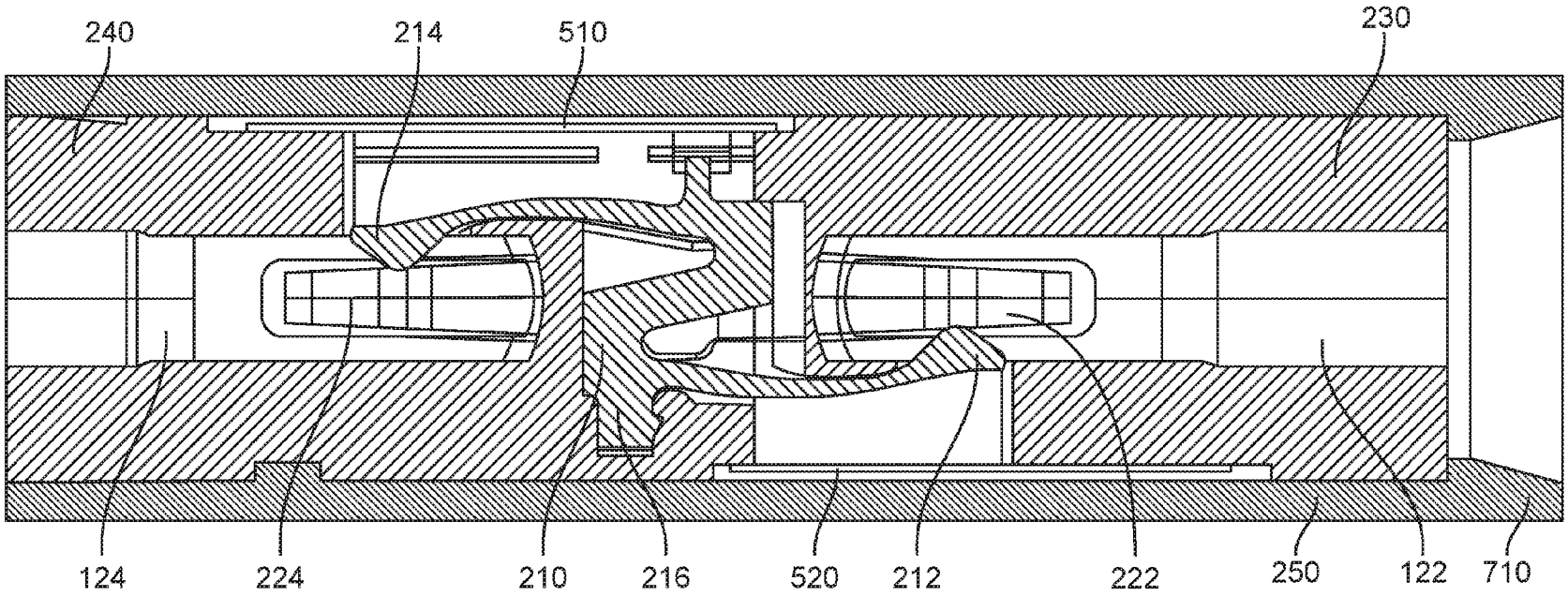
FIG. 7 illustrates a side view of an adapter according to an embodiment of the present invention.

FIG. 7 illustrates a side view of an adapter according to an embodiment of the present invention. This side view illustrates contacts 210. Contacts 210 may have a first contacting portion 212 in receptacle 122 and a second contacting portion 214 in receptacle 124. This general "Z" shape may allow connector receptacle 122 to be in close proximity to connector receptacle 124, thereby reducing an overall length of adapter 120. Each contact 210 may include barb 216, which may be barbed into housing 240 for mechanical stability. Side ground contacts may have contacting portion 224 in receptacle 124 in housing 240 and contacting portion 222 in receptacle 122 in housing 230 Insulating layers 510 and 520 may be placed over a top of housing 240 and a bottom of housing 230 to prevent contacts 210 from contacting outer housing 250. Outer housing 240 may include an overhang 710. Overhang 710 may extend a depth of the receptacle 122 provided by housing 230.

Overhang 710 may extend a depth of receptacle 122 and may further simplify the manufacturing of the adapter. Again, in various embodiments of the present invention, it may be desirable to align an outside of second housing 240 to an outside edge of housing 250. A may also be desirable to align an outside edge of first housing 230 with an outside edge of outer housing 250. Accordingly, a compressible or otherwise adjustable or compliant region may be placed or located between first housing 230 and second housing 240. In this way, the spacing between first housing 230 and second housing 240 may be adjusted thereby allowing the outside edges of housings 230 and 240 to be aligned to the outside edges of outer housing 250. By using overhang 710, first housing 230 may be assembled to second housing 240. The two housings may be inserted into outer housing 250, or outer housing 250 may be formed around first housing 230 and second housing 240. The outside edge of second housing 240 may be aligned with a corresponding edge of outer housing 250. Any errors in the dimensions of the lengths of first housing 230 and second housing 240 may be compensated for, or masked by, the presence of overhang 710. In this way, the presence of a compressible or otherwise adjustable or compliant region may be obviated.

Figure 8:
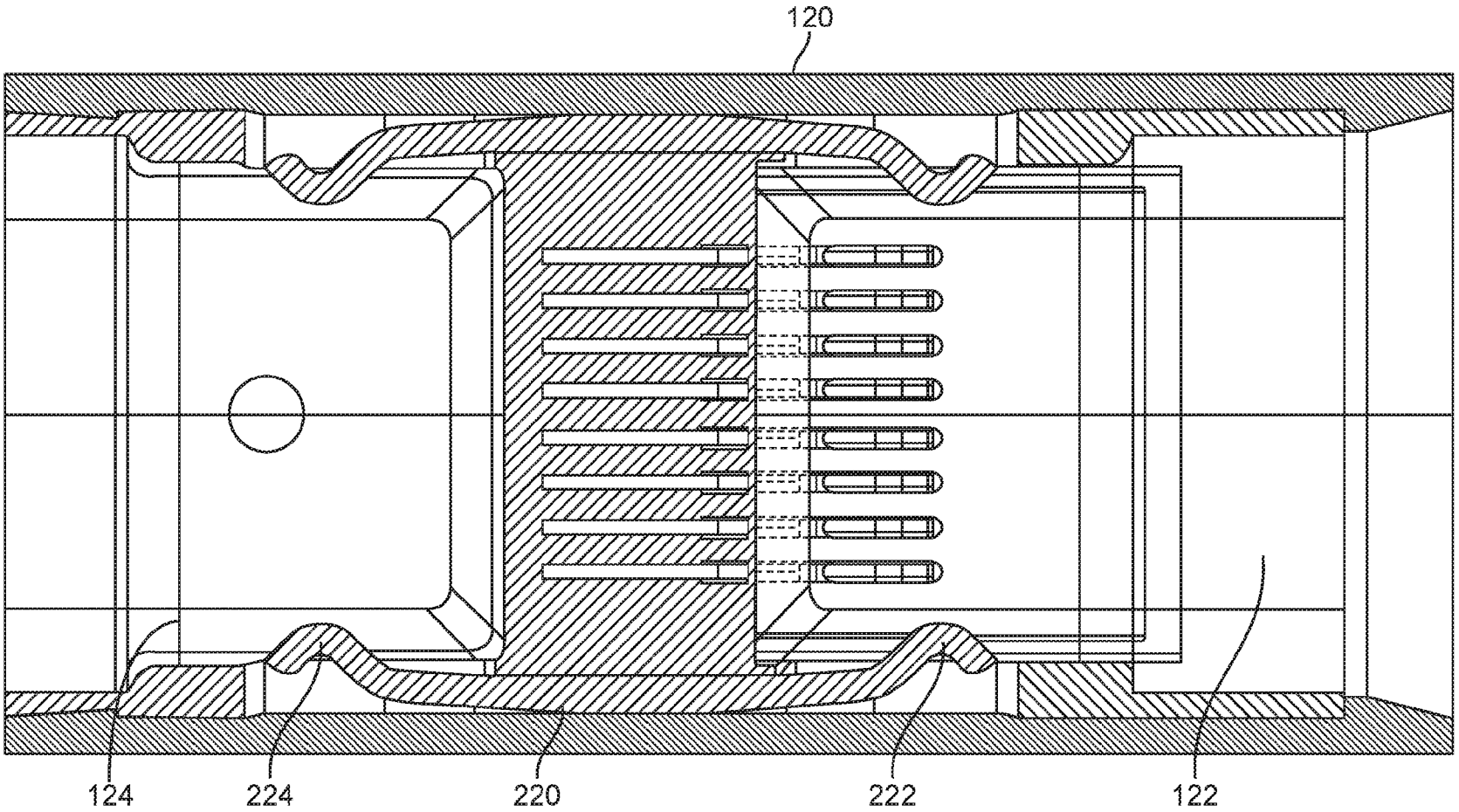
FIG. 8 illustrates a cutaway top view of an adapter according to an embodiment of the present invention.

FIG. 8 illustrates a cutaway top view of an adapter according to an embodiment of the present invention. This figure illustrates contacting portions 222 and 224 of side ground contacts 220. Again, contacting portion 222 may provide a reduced retention force such that adapter 120 disconnects at receptacle 122 before it disconnects at receptacle 124. In various embodiments of the present invention, contacting portion 222 may not extend as far into its connector receptacle 122 as does contacting portion 224 into its connector receptacle 124, or contacting portion 222 may have a different shape, length, or other feature as compared to contacting portion 224. In other embodiments of the present invention, contacting portion 224 may not extend as far into its connector receptacle 124 as does contacting portion 222 into its connector receptacle 122, or contacting portion 224 may have a different shape, length, or other feature as compared to contacting portion 222.

Figure 9:
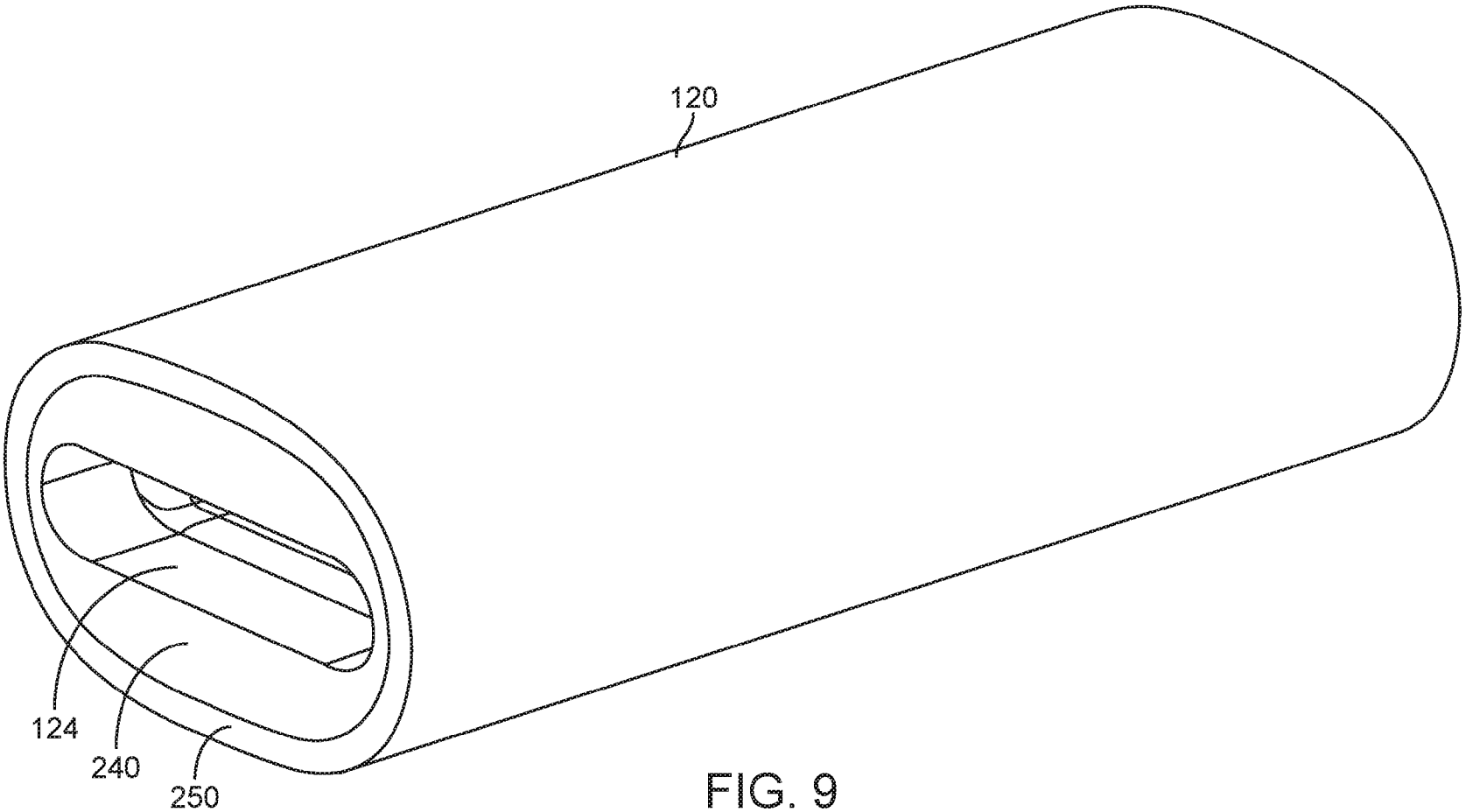
FIG. 9 illustrates an adapter according to an embodiment of the present invention.

FIG. 9 illustrates an adapter according to an embodiment of the present invention. Adapter 120 may have an outer housing 250 surrounding housing 240, which may include opening for receptacle 124.

Figure 10:
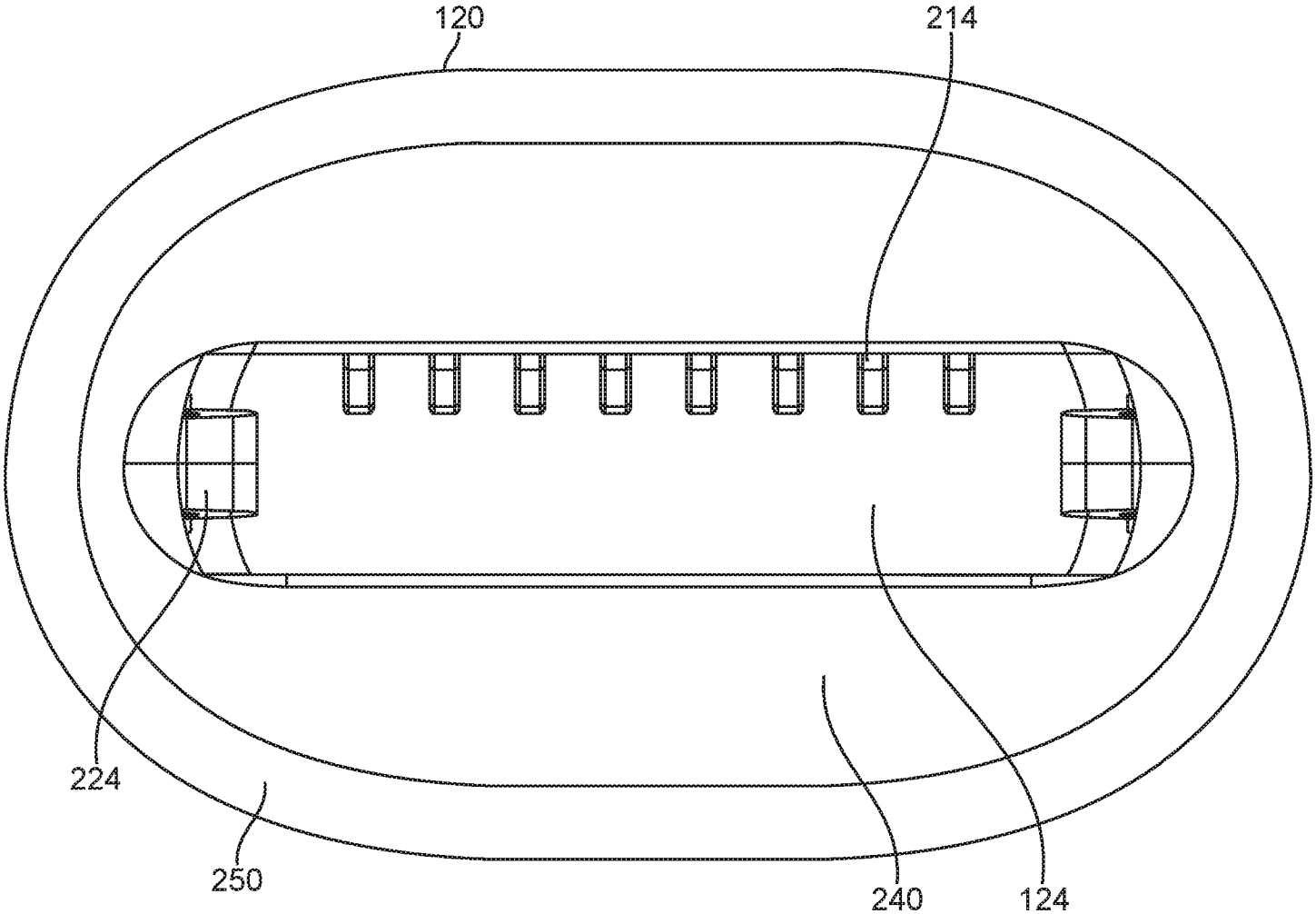
FIG. 10 illustrates a front view of an adapter according to an embodiment of the present invention.

FIG. 10 illustrates a front view of an adapter according to an embodiment of the present invention. Again, adapter 120 may include outer housing to 50 around second housing 240. Second housing 240 may include an opening for connector receptacle 124. Contacting portions 214 of contacts 210 and side ground contacting portions 224 may be located in connector receptacle 124.

In various embodiments of the present invention, components of the adapters may be formed in various ways of various materials. For example, conductive portions may be formed by stamping, metal-injection molding, machining, micro-machining, 3-D printing, or other manufacturing process. The conductive portions may be formed of stainless steel, steel, copper, copper titanium, phosphor bronze, palladium, palladium silver, or other material or combination of materials. They may be plated or coated with nickel, gold, or other material. The nonconductive portions, such as the housings and other portions, may be formed using injection or other molding, 3-D printing, machining, or other manufacturing process. The nonconductive portions may be formed of silicon or silicone, Mylar, Mylar tape, rubber, hard rubber, plastic, nylon, elastomers, liquid-crystal polymers (LCPs), ceramics, or other nonconductive material or combination of materials.

Embodiments of the present invention may provide adapters that may be connected to various types of devices, such as portable computing devices, tablet computers, desktop computers, laptops, all-in-one computers, wearable computing devices, cell phones, smart phones, media phones, storage devices, cases, covers, keyboards, pens, styluses, portable media players, navigation systems, monitors, power supplies, adapters, remote control devices, chargers, and other devices. These adapters may include connector receptacles or connector inserts that may provide pathways for signals and power compliant with various standards such as one of the Universal Serial Bus (USB) standards including USB Type-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An adapter comprising:

a first housing for a first receptacle;

a second housing for a second receptacle;

a plurality of contacts having first contacting portions in the first receptacle and second contacting portions in the second receptacle; and a plurality of side ground contacts, each side ground contact having a first contacting portion in the first receptacle and a second contacting portion in the second receptacle, wherein the second receptacle has a greater depth than the first receptacle, and wherein a first retention force provided by the first contacting portions of the plurality of side ground contacts is greater than a second retention force provided by the second contacting portions of the plurality of side ground contacts.

2. The adapter of claim 1 wherein the first housing and the second housing snap together.

3. The adapter of claim 1 wherein the first contacting portions of each side ground contact extends a greater distance into the first receptacle than the second contacting portions of each side ground contact extends into the second receptacle.

4. The adapter of claim 1 wherein the side ground contacts each are attached to a boss on either the first housing or the second housing using heat staking.

5. The adapter of claim 4 further comprising an outer housing around the first housing and the second housing.

6. The adapter of claim 5 further comprising a compressible region between the first housing and the second housing such that openings of the first housing and the second housing may be aligned with openings in the outer housing.

7. The adapter of claim 1 wherein the first receptacle and the second receptacle have the same number of contacting portions of the plurality of contacts.

8. The adapter of claim 7 wherein a spacing between each adjoining first contacting portion in the first receptacle is the same as a spacing between each adjoining second contacting portion in the second receptacle.

9. An adapter comprising:

a first receptacle formed by a first housing having a plurality of slots, each slot for a first contacting portion of one of a plurality of contacts;

a second receptacle formed by a second housing having a plurality of slots, each slot for a second contacting portion of one of the plurality of contacts; and a plurality of side ground contacts, each side ground contact having a first contacting portion in the first receptacle and a second contacting portion in the second receptacle, wherein a first retention force provided by the first contacting portions of the plurality of side ground contacts in the first receptacle is greater than a second retention force provided by the second contacting portions of the plurality of side ground contacts in the second receptacle.

10. The adapter of claim 9 wherein a tab on the first housing fits in a slot in the second housing such that the first housing and the second housing snap together.

11. The adapter of claim 9 wherein the side ground contacts each are attached to a boss on either the first housing or the second housing using heat staking.

12. The adapter of claim 9 wherein the second receptacle is deeper than the first receptacle.

13. The adapter of claim 12 wherein the first contacting portions of each side ground contact extends a greater distance into the first receptacle than the second contacting portions of each side ground contact extends into the second receptacle.

14. The adapter of claim 9 further comprising an outer housing around the first housing and the second housing.

15. The adapter of claim 14 wherein the outer housing comprises an overhang extending beyond the second housing thereby further increasing a depth of the second receptacle.

16. The adapter of claim 9 wherein a spacing between each adjoining first contacting portion in the first receptacle is the same as a spacing between each adjoining second contacting portion in the second receptacle.

17. The adapter of claim 16 wherein the first receptacle and the second receptacle have the same number of contacting portions of the plurality of contacts.

18. An adapter comprising:

a first side ground contact;

a second side ground contact;

a first receptacle wherein a first contacting portion of the first side ground contact and a first contacting portion of the second side ground contact provide a first retention force on a first connector insert when the first connector insert is inserted in the first receptacle; and a second receptacle wherein a second contacting portion of the first side ground contact and a second contacting portion of the second side ground contact provide a second retention force on a second connector insert when the second connector insert is inserted in the second receptacle, wherein the first contacting portion of the first side ground contact and the first contacting portion of the second side ground contact extend a greater distance into the first receptacle than the second contacting portion of the first side ground contact and the second contacting portion of the second side ground contact extend into the second receptacle such that the first retention force is greater than the second retention force.

19. The adapter of claim 18 wherein the first receptacle is formed by a first housing, the second receptacle is formed by a second housing, the second housing longer than the first housing.

20. The adapter of claim 19 further comprising:

an outer housing having an overhang portion extending beyond the second housing.

21. The adapter of claim 20 wherein a tab on the first housing fits in a slot in the second housing such that the first housing and the second housing snap together.

22. The adapter of claim 20 wherein the overhang portion provides a greater depth for the second receptacle than the first receptacle.

23. The adapter of claim 18 further comprising a plurality of contacts having first contacting portions in the first receptacle and second contacting portions in the second receptacle, wherein the first receptacle and the second receptacle have the same number of contacting portions of the plurality of contacts.

24. The adapter of claim 23 wherein a spacing between each adjoining first contacting portion in the first receptacle is the same as a spacing between each adjoining second contacting portion in the second receptacle.

* * * * *